US005720319A

United States Patent [19]

Smith et al.

[11] Patent Number: 5,720,319

[45] Date of Patent: Feb. 24, 1998

[54] CAST IN JOINT OF ALUMINUM TAILSPOUT AND STAINLESS STEEL EXHAUST PIPE

[75] Inventors: Ralph Wayne Smith, East Lansing; Lloyd Charles Kendall, Williamston; David Lynn Penfield, Grand Ledge; Robert James Ezze, Lansing; Joel Ardon Litchfield, Okemos, all of Mich.

[73] Assignee: General Motors Corporation, Detroit, Mich.

[21] Appl. No.: 704,012

[22] Filed: Aug. 26, 1996

[51] Int. Cl.[6] ..... F16L 9/02

[52] U.S. Cl. ..... 138/109; 138/142; 138/143; 138/147; 181/228

[58] Field of Search ..... 138/109, 96 R, 138/142, 143, 147, 171, 108; 181/228

[56] References Cited

U.S. PATENT DOCUMENTS

| | | | |
|---|---|---|---|
| 3,318,533 | 5/1967 | Besoyan | 138/109 |
| 3,621,883 | 11/1971 | Miller | 138/143 |
| 3,792,722 | 2/1974 | Harmon | 138/108 |
| 3,830,262 | 8/1974 | Lago | 138/109 |
| 4,590,116 | 5/1986 | Joly | 138/142 |
| 4,596,306 | 6/1986 | Abe et al. | 181/226 |
| 4,998,597 | 3/1991 | Bainbridge et al. | 138/109 |
| 5,406,983 | 4/1995 | Chambers et al. | 138/143 |

*Primary Examiner*—David Scherbel
*Assistant Examiner*—James F. Hook
*Attorney, Agent, or Firm*—Cary W. Brooks

[57] ABSTRACT

The present invention includes a cast in place aluminum tailspout and a stainless steel exhaust pipe. The stainless steel exhaust pipe includes a flared out portion. The cast in place tailspout includes a section that surrounds at least a portion of the flared section of the exhaust pipe and includes a hooked finger for engaging an outwardly extending shoulder of the flared portion.

2 Claims, 1 Drawing Sheet

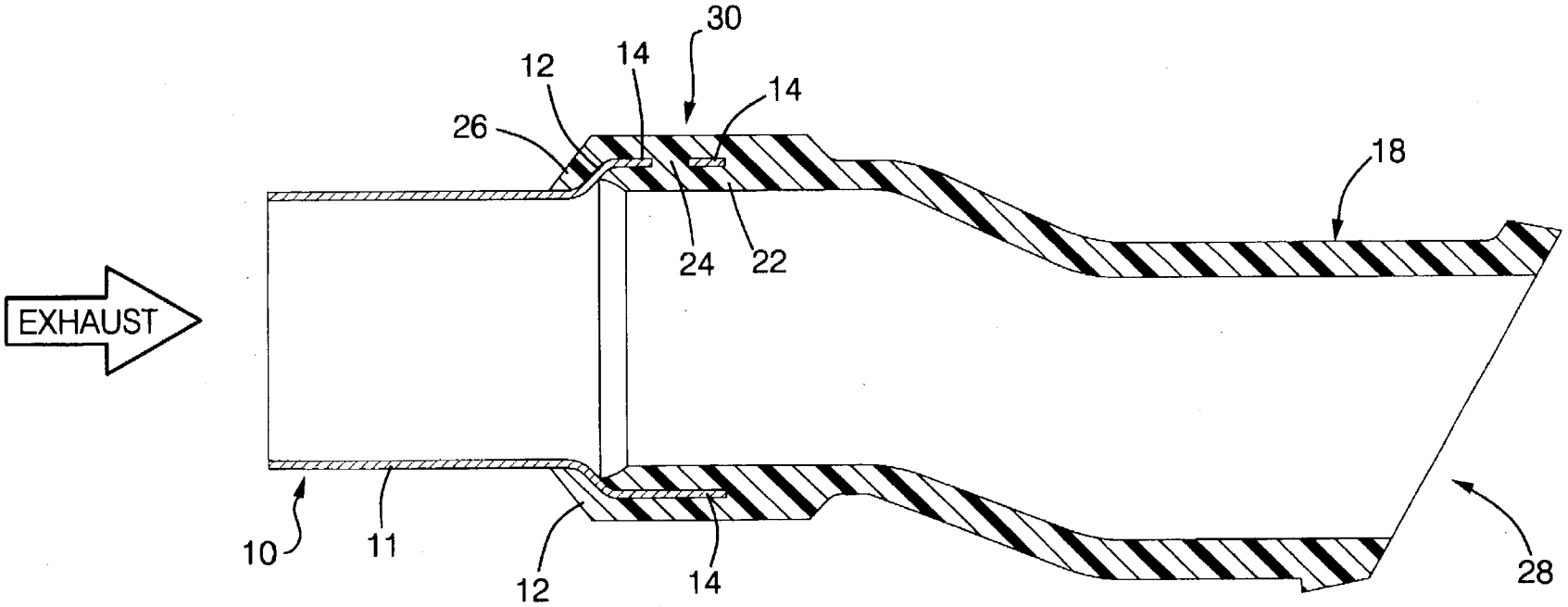
28
18
30
14
22
24
14
14
12
26
12
11
10
EXHAUST

CAST IN JOINT OF ALUMINUM TAILSPOUT AND STAINLESS STEEL EXHAUST PIPE

TECHNICAL FIELD

This invention relates to exhaust systems for combustion engines.

BACKGROUND OF THE INVENTION

Combustion engines such as those associated with automotive vehicles include exhaust piping systems for exhausting combustion engine gases to the atmosphere. The exhaust system may include a manifold connected to the combustion engine, an exhaust piping attached to the manifold, a catalytic converter, a muffler, additional exhaust pipe and a tailspout to serve both functional and decorative purposes. In prior exhaust systems, an aluminum tailspout had been attached to a stainless exhaust pipe using pipe clamps. Clamps were used because it was not possible to weld the aluminum tailspout to the stainless steel. These pipe clamps often become inadvertently damaged when the vehicles passed over a bump in the road, a driveway or a curb. The clamps either were knocked off or the tailspout became misaligned.

The present invention provides advantages and alternatives over the prior art.

SUMMARY OF THE INVENTION

The present invention includes a cast in place aluminum tailspout and a stainless steel exhaust pipe. The stainless steel exhaust pipe includes a flared out portion. The cast in place tailspout includes a section that surrounds at least a portion of the flared section of the exhaust pipe and includes a hooked finger for engaging an outwardly extending shoulder of the flared portion.

These and other objects, features and advantages will become apparent from the following brief description of the drawing, detailed description and appended claims and drawing.

BRIEF DESCRIPTION OF THE DRAWING

The drawing illustrates a sectional view of a cast in joint aluminum tailspout and stainless steel exhaust pipe according to the present invention.

DETAILED DESCRIPTION

The present invention includes a cast in place aluminum tailspout for a stainless steel exhaust pipe. The invention is utilized for a vehicle having a combustion engine, a manifold connected to the combustion engine, an exhaust pipe extending from the manifold to a catalytic converter and muffler, and addition exhaust pipe extending the muffler in a manner which is known to those skilled in the art. In the present invention, exhaust from the combustion engine proceeds down the exhaust system and enters a section of an exhaust pipe 10 in the direction of the arrow shown in the drawing. The exhaust pipe is preferably stainless steel and includes a first section of piping 11 closest to the combustion engine and having a first diameter or cross-sectional area. The system also includes a second section of piping 14 further from the combustion engine and having a second diameter or cross-sectional area which is greater than the diameter or cross-sectional area of the first section of piping. A flared out section of the piping is defined by an outwardly extending shoulder 12 connected at one end to the first section of piping and to the second section of piping at the other end. A aluminum tailspout 18 having an opening at a first end 28 for exhausting combustion gas to an atmosphere and having a second end 30 cast around a portion of the exhaust pipe 10. The aluminum tailspout 18 is a single piece integral casting and does not include multiple pieces joined together. The tailspout includes a first section 20 surrounding the outer surface of the flared out section of the exhaust pipe and including an inwardly extending hooked finger 26 immediately adjacent and surrounding the outside surface of the outwardly extending shoulder 12 of the exhaust pipe. The tailspout also includes a second portion 20 immediately adjacent and surrounding at least a portion of the inside surface of the second section 14 of the exhaust pipe. The exhaust pipe may have holes 16 formed in the flared out portion or second section into which the aluminum tailspout is cast at 24. This construction firmly holds the aluminum tailspout in position overcoming the disadvantages of the prior art.

We claim:

1. An aluminum tailspout and stainless steel exhaust pipe combination comprising a stainless steel exhaust pipe having a first section of a first cross-sectional area and a flared out section having a second cross-sectional area that is greater than the first cross-sectional area, an aluminum tailspout casting surrounding a portion of the flared out section of the exhaust pipe, wherein said exhaust pipe includes a shoulder extending outwardly from the first section of exhaust pipe and connected to a second section of the exhaust pipe, the shoulder and second section of the exhaust pipe each having an inside wall and an outside wall, and wherein said aluminum tailspout includes a portion surrounding the outside wall of the shoulder and the second section and surrounding a portion of the inside wall of the second section.

2. A cast in place aluminum tailspout and stainless steel exhaust pipe as set forth in claim 1 wherein said exhaust pipe has holes formed in the second section and the aluminum tailspout includes portions extending through said holes.

* * * * *